US007217340B2

(12) United States Patent
Nguyen

(10) Patent No.: US 7,217,340 B2
(45) Date of Patent: May 15, 2007

(54) CHEMICAL SOFTENING COMPOSITION FOR PAPER PRODUCTS

(75) Inventor: Duy T. Nguyen, Houston, TX (US)

(73) Assignee: Huntsman Petrochemical Corporation, The Woodlands, TX (US)

( * ) Notice: Subject to any disclaimer, the term of this patent is extended or adjusted under 35 U.S.C. 154(b) by 0 days.

(21) Appl. No.: 11/280,165

(22) Filed: Nov. 16, 2005

(65) Prior Publication Data

US 2006/0075575 A1 Apr. 13, 2006

Related U.S. Application Data

(62) Division of application No. 10/374,457, filed on Feb. 26, 2003, now Pat. No. 7,012,058.

(51) Int. Cl.
*D21H 23/22* (2006.01)

(52) U.S. Cl. ..... 162/158; 510/527

(58) Field of Classification Search ..... 162/158; 510/527

See application file for complete search history.

(56) References Cited

U.S. PATENT DOCUMENTS 6,547,925 B1 * 4/2003 Drew et al. ..... 162/111

FOREIGN PATENT DOCUMENTS

| | | |
|---|---|---|
| EP | 1013825 | * 6/2000 |
| WO | WO 01/85109 | * 11/2001 |

* cited by examiner

*Primary Examiner*—John R. Hardee
(74) *Attorney, Agent, or Firm*—Ron D. Brown; Edward Korompai

(57) ABSTRACT

A chemical softening composition includes a amide-substituted quaternary imidazolinium salt, a nonionic surfactant, and a polyhydroxy compound for use in treating cellulosic materials including papers, textiles and fabrics. The chemical softening composition can be applied to papermaking fibers during a papermaking process to provide a softened paper web and product possessed of sufficient tensile strength for its regular employment. A chemical softening composition according to the invention can also be applied to fabric to soften the fabric, provide easier handling of the fabric, and also reduce the tendency of the fabric to generate and store static electricity.

10 Claims, No Drawings

CHEMICAL SOFTENING COMPOSITION FOR PAPER PRODUCTS

This application is a divisional application of U.S. patent application Ser. No. 10/374,457 which was filed on Feb. 26, 2003 now U.S. Pat. No. 7,012,058 and which is currently still pending.

TECHNICAL FIELD

The present invention relates to compositions of matter and processes useful for treating paper and other materials and products which contain cellulosic fibers. More particularly, it relates to increasing the degree to which paper products and fabrics feel soft to the touch.

BACKGROUND INFORMATION

Making paper or textile products soft without impairing performance characteristics such as strength or absorbency has long been the goal of various workers. Softness is the tactile sensation perceived by a person who holds a particular paper or textile product and rubs it across the skin. Such tactilely-perceivable softness can be characterized by, but is not limited to, friction, flexibility, and smoothness, as well as subjective descriptors, such as a feelings of lubriciousness, or softness textures reminiscent of velvet, silk, or flannel. However, improvement of softness in almost all cases comes at the expense of strength or absorbancy of the fibrous material.

One method for improving softeness in paper products is to select or modify cellulose fiber morphologies to those which provide advantageous microstructures. However, while incorporation of upgraded cellulose fiber sources into paper products can improve softness, it is often the case that upgraded fiber sources offer limited ability to confer the properties of durability and absorbency to paper products produced therefrom, and the resulting paper products are typically possessed of the best achieveable balance between softness and strength for the treatment method or system utilised.

Another area that has received a considerable amount of attention in improving paper softness is the addition of chemical softening agents to the fiber furnish during the papermaking process. For example, chemical softening agents can be applied to the paper web during its formation either by adding the softening agent to the vats of pulp which will ultimately be formed into a paper web, to the pulp slurry as it approaches a paper making machine, or to the wet paper web as it resides on a Fourdrinier cloth or dryer cloth on a papermaking machine. In addition, the chemical softening agent can be applied to a finished paper web after it has dried.

To ensure an optimum level of softening efficiency in general, a high degree of attraction of the chemical softening composition to the fibers used in the manufacture of papers is necessary. It has been known that, because of their charge, cationic softeners have a strong affinity for the papermaking fibers and are a good softener. In comparison, anionic debonders, because they have the same charge as the fiber, are not sufficiently retained on the fiber furnish to function effectively as softeners. In addition, anionic debonders contribute to wet-end deposition and significant foaming that is in general overall detrimental to the papermaking process. Nonionic surfactants have no ionic attraction for the fibers whatsoever, and as a result, when nonionics are employed it is necessary for them to be applied to the wet paper web.

During the papermaking process, cationic debonders, when employed, are typically added to water to make an emulsion, and then added to the fiber furnish. Unfortunately, addition of cationic debonders to the fiber furnish often results in a significant reduction of strength in the paper web (strength being the ability of the paper product, and its constituent paper webs, to maintain physical integrity and to resist tearing, bursting, and shredding under use conditions). This reduction in strength is believed to result from a disruption of hydrogen bonds between the papermaking fibers that are formed as a result of the papermaking process. In order to offset the effects of the strength reduction that occurs because of the cationic debonder addition, dry strength additives must be added; however, these additives often negate the softness benefits imparted by the cationic debonder addition.

Various compositions are known in the art as being useful for conferring softness to paper products For example, published U.S. Patent Application No. 20020112831 discloses a paper softening composition containing a quaternary ammonium compound, water, and a nonionic surfactant. Other compositions and methods for paper softening are disclosed in U.S. Pat. Nos. 6,458,343; 6,369,007; 6,315,866; 6,245,197; 6,200,938; 6,179,961; 6,004,914; 5,753,079; 5,538,595; 5,385,642; 5,322,630; 5,240,562; 4,959,125; 4,940,513; 4,720,383; 4,441,962; 4,351,699; and 3,554,862, the entire contents of which aforesaid patent documents are herein incorporated by reference thereto in their entirety.

One of the most important physical properties related to softness is generally considered by those skilled in the art to be the strength of the paper web. Accordingly, there is a continuing need for soft paper and textile products having good strength properties. There is also a need for improved softening compositions that can be applied to such paper and textile products to provide the requisite softness without unacceptably degrading the strength of the product.

SUMMARY OF THE INVENTION

The present invention provides chemical softening compositions useful for softening fibers of cellulosic materials, including paper, without seriously detracting from the strength of final products formed through their use. A composition according to the invention includes: an amide-substituted quaternary imidazolinium salt; a nonionic surfactant; and a polyhydroxy compound. In one form of the invention, the nonionic surfactant includes ester adducts of polyethylene glycol, and the polyhydroxy compound is selected from the group consisting of: glycerine, a polyalkylene glycol, or mixtures of the foregoing.

The present invention also provides a process for making a soft durable paper web by applying a chemical softening composition described in accordance with the invention to fibers employed in the papermaking process. Such a process according to the invention comprises the steps of forming an aqueous dispersion of papermaking fibers, dewatering the dispersed fibers by depositing them onto a flat surface, and drying the dispersed fibers sufficiently to form a paper product. The chemical softening composition can be applied directly to the dispersed fibers either prior to, or subsequent to the dewatering step.

A chemical softening composition according to the present invention may also be applied to fabric (that is, articles of clothing, or textiles) to impart softness properties to the fabric, as well as increasing their ease of handling and lubricity, and reducing their tendency to accumulate and store static electricity.

Any cellulosic material, including without limitation paper fibers and fabrics, may be treated in accordance with the present invention. Any material bearing cellulose may be treated by contact with an aqueous solution according to the invention.

DETAILED DESCRIPTION OF THE INVENTION

The chemical softening composition according to the present invention comprises a amide-substituted quaternary imidazolinium salt, a nonionic surfactant, and a polyhydroxy compound. A chemical softening composition according to a preferred form of the invention comprises any amount from about 1.00% to about 20.00% by weight based on the total weight of the finished composition of the amide-substituted quaternary imidazolinium salt. It is preferred that the nonionic surfactant component be present in any amount between 20.00% and 90.00% by weight based upon the total weight of the composition. According to a preferred form of the invention, the polyhydroxy compound component is present in any amount between 1.00% and 20.00% by weight based upon the total weight of the composition.

In order to provide a composition according to the invention, the various components are merely mixed together using conventional mechanical agitation and mixing means known to those with skill in the art as being useful for combining liquids to form mixtures, including blending in a tank or passing the liquids through a static mixer, or other functionally-equivalent means of agitation.

Preferably, the amide-substituted quaternary imidazolinium salt is formed from quatemizing (alkylating) a material having the following general structure:

(I)

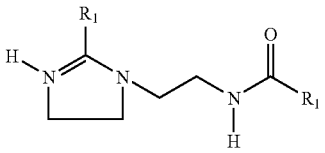

with dimethyl sulfate, diethyl sulfate, or an monoalkyl halide such as, preferably, the bromides or chlorides of alkanes such as methane and ethane, as such alkylations are well known to those skilled in the art. The material above may be produced by reaction between diethylenetriamine and 2 moles of a carboxylic acid (preferably a fatty acid) and the subsequent removal of water, which techniques are known by those skilled in the art. In addition, such materials are available from Huntsman International LLC of The Woodlands, Tex. In the embodiment in which dimethyl sulfate is employed as the alkylating agent, the amide-substituted quaternary imidazolinium salt is the quaternized (quaternary) amide-substituted imidazolinium methosulfate salt (II) having the general structure shown below:

(II)

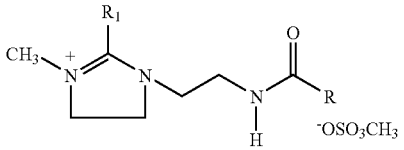

in which R is independently in each occurrence a hydrocarbyl group having any number of carbon atoms between 8 and 22. It is believed to be readily appreciated by those skilled in the art that in cases where sulfates other than dimethyl sulfate are employed in quatemizing, the anion in the formula above will correspond to the anion of the other sulfate used, as such is known to those skilled in the art of the use of sulfates in alkylations.

The term "hydrocarbyl" as used in this specification and the claims appended hereto refers to a hydrocarbon group having a carbon atom directly attached to the remainder of the molecule and having predominantly hydrocarbon character. Examples of hydrocarbyl substituents or groups within this definition include: (1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical); (2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy); (3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents such as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

It is readily appreciable by those skilled in the art that commercial fatty acids may in some cases be comprised of mixtures of fatty acids having different hydrocarbon tails representing a distribution of several different carbon numbers. Accordingly, a finished solution according to the invention when prepared using fatty acids as a raw material will thus often include a mixture of different cations derived from the alkylation of the material defined by the structure of the imidazoline (I) above which may have two hydrocarbyl R groups that individually may either comprise the same or different chain lengths as each other (i.e., both $R_1$ groups of a given cation, structure (III) below, may be the same or different). According to one form of the invention, the mixture comprises at least two quatrenary cations which differ in structure with respect to the identity of the $R_1$ groups present, within the meaning of the term hydrocarbyl.

A amide-substituted quaternary imidazolinium salt useful in accordance with the present invention can be prepared by any of the means well known to those skilled in the chemical arts. For example, it can be prepared by forming an amide by reacting 1 mole of diethylenetriamine with 2 moles of a fatty acid selected, without limitation from the group consisting of: oleic acid; palimitic acid; stearic acid; linoleic acid; linolenic acid; decenoic acid; decanoic acid; dodecanoic acid; hexadecanoic acid; octanoic acid; and tetradecanoic acid. Any known carboxylic acid having between 8 and 22 carbon atoms is suitable for forming such amide, whether saturated, mono-unsaturated, or poly-unsaturated. The amide is subsequently quaternized using dimethyl sulfate, which general methylation method is familiar to those skilled in the art.

A chemical softening composition according to one form of the present invention includes from 1.00 percent to 20.00 percent by weight of amide-substituted imidazolinium methosulfate salt. More preferably, the chemical softening composition includes from 3.00 percent to 15.00 percent by weight of the amide-substituted imidazolinium methosulfate salt. Most preferably, the chemical softening composition includes from 5.00 percent to 10.00 percent by weight of the amide-substituted imidazolinium methosulfate salt. It has been found that addition of a chemical softening composition having greater than 20.00 percent by weight of the amide-substituted imidazolinium methosulfate salt during the papermaking process negatively impacts the strength of the paper web during processing as well as the resulting paper product.

The nonionic surfactant of the present invention includes ester adducts of ethylene oxide, polyethylene glycol, polypropylene glycol and fatty materials such as fatty acids, alcohols, and esters. Generally, the fatty moiety of the nonionic surfactant can include from about twelve (12) to about eighteen (18) carbon atoms. The ethylene oxide moiety of the nonionic surfactants can include from two (2) to twelve (12) moles of ethylene oxide.

Examples of nonionic surfactants that can be used are polyethylene glycol dioleate, polyethylene glycol dilaurate, polypropylene glycol dioleate, polypropylene glycol dilaurate, polyethylene glycol monooleate, polyethylene glycol monolaurate, polypropylene glycol monooleate and polypropylene glycol monolaurate. The present invention contemplates the use of any known nonionic surfactant in its compositions and processes.

The nonionic surfactant can also include blends of ester adducts of polyethylene glycol and polypropylene glycol. Particularly preferred are blends of polyethylene glycol dioleate and polyethylene glycol dilaurate. For example, the nonionic surfactant of the present invention can include a blend of polyethylene glycol 400 dioleate and polyethylene glycol 200 dilaurate having from about twenty 20.00 to about eighty 80.00 percent by weight of polyethylene glycol 400 dioleate and from about 20.00 to about 80.00 percent of polyethylene glycol 200 dilaurate. Preferably, the nonionic surfactant blend contains from about thirty 30.00 percent to about seventy 70.00 percent of polyethylene glycol 400 dioleate and from about thirty 30.00 percent to seventy 70.00 percent by weight of polyethylene glycol 200 dilaurate, and most preferably from about thirty five 35.00 percent to about sixty 60.00 percent by weight of polyethylene glycol 400 dioleate and from about thirty five 35.00 percent to about sixty 60.00 percent by weight of polyethylene glycol 200 dilaurate.

The polyhydroxy compound of the present invention can be selected from the group consisting of: polyols, glycerine (glycerol), polyethylene glycols and polypropylene glycols. Preferably, the polyhydroxy compound has an average molecular weight from about 200 to about 4000, more preferably from about 200 to about 1000 and most preferably from about 200 to about 600. An example of a polyhydroxy compound useful as a component of the present invention includes POGOL® 400 sold by Huntsman International LLC (The Woodlands, Tex.).

The polyhydroxy compound is added to the chemical softening composition of the present invention so that the chemical softening composition contains from about one 1.00 percent to about twenty 20.00 percent by weight of the polyhydroxy compound. More preferably, the chemical softening composition contains from about one 1.00 percent to about ten 10.00 percent by weight of the polyhydroxy compound, and most preferably from about one 1.00 percent to about five 5.00 percent by weight of the polyhydroxy compound.

The papermaking fibers utilized in the present invention comprises fibers derived from wood pulp. Other cellulosic fibrous pulp fibers, such as cotton linters, bagasse, etc., can be utilized and are intended to be within the scope of this invention. Synthetic fibers, such as rayon, polyethylene and polypropylene fibers, may also be utilized in combination with natural cellulosic fibers. One exemplary polyethylene fiber that may be utilized is PULPEX®, available from HERCULES INCORPORATED. (Wilmington, Del.).

Wood pulps which may be treated using a composition according to the present invention include the chemical pulps such as Kraft, sulfite, and sulfate pulps, as well as mechanical pulps including groundwood, thermomechanical pulp, and chemically-modified thermomechanical pulp. Chemical pulps, however, are preferred raw materials since they impart a superior tactile sense of softness to sheets made therefrom. Those pulps derived from both deciduous trees (hereinafter, also referred to as "hardwood") and coniferous trees (hereinafter, also referred to as "softwood") may be utilized. Also treatable in accordance with the present invention are fibers derived from recycled paper, which may contain any or all of the above categories as well as other non-fibrous materials such as fillers and adhesives used to facilitate the original papermaking.

A chemical softening composition according to the present invention can be used with any known technique for preparing paper products. Generally, the process for the manufacture of paper with which the chemical softening composition of the present invention is useful includes the steps of establishing a uniform aqueous dispersion of papermaking fibers, forming that dispersion into a flat sheet, and dewatering and drying the sheet to form paper that can be rolled, cut, and formed as desired into any one of several finished products including napkins, toweling, and facial and toilet tissue. During processing, the chemical softening composition may be applied directly to an aqueous dispersion of papermaking fibers either prior to or after dewatering to provide a soft, durable paper web.

For example, a chemical softening composition according to the invention is used in a typical papermaking process, where an aqueous dispersion of papermaking fibers is first provided from a pressurized headbox. The head box has an opening for delivering a thin deposit of the dispersed fibers onto a Fourdrinier wire to form a wet paper web. As used herein, the terms "paper web" or "wet paper web" are intended to designate any of the nonwoven materials commonly used as paper products from which a portion thereof includes papermaking fibers.

The wet paper web is dewatered to a fiber consistency of between about 7% and about 25% (total web weight basis) by vacuum dewatering and further dried by pressing operations where the paper web is subjected to pressure developed by opposing mechanical members such as cylindrical rolls. The dewatered paper web can then be further pressed and dried by a steam drum apparatus known in the art as a Yankee dryer. Pressure is developed at the Yankee dryer by mechanical means such as an opposing cylindrical drum pressing against the paper web. Multiple Yankee dryer drums can also be employed for additional pressing if necessary or desirable. Subsequent processing such as creping, calendering and/or reeling can also be used to further increase stretch, bulk and softness, and to control caliper.

As described above, the aqueous dispersion of papermaking fibers are obtained by any of the numerous known processes, such as pulp of virgin pulpwood, from recycled paper and/or cardboard stock, or mixtures thereof. The pulp is subjected to treatment by any of several conventional processes to help establish a dispersion of fibers sufficiently finely dispersed to constitute an acceptable dispersion that can be processed into paper. The pulp can also be treated, for example, mechanically, chemically, or both, and is often subjected to heat to convert it to a processable dispersion. Several chemical processes such as the Kraft process are well known in this field.

The papermaking fibers, as that term is used herein, include any of a chemical constituency and physical form that can be formed into an aqueous dispersion that can in turn be produced into paper. Generally the papermaking fibers are predominantly cellulosic but may also contain lignins, hemi-cellulosics, and other fibrous components derived from synthetic polymers, cloth, and the like.

The aqueous dispersion of papermaking fibers is formed into a flat sheet, usually by means of a machine specially adapted for this function. Preferably, a Fourdrinier or equivalent machine presenting a wide, flat, porous screen (which can move at a predetermined rate) has at one end a means such as a headbox which contains the aqueous dispersion of papermaking fibers and which feeds the aqueous dispersion at a controlled rate onto one end of the screen.

The flat sheet formed in this or any equivalent manner still contains a substantial portion of water. As the flat sheet is carried along on the screen, water is removed through the screen by its own weight and often with the aid of pressure, heat, or both. The flat sheet can then be treated with other equipment such as heated calender rollers or the like, which further reduces the moisture content until the sheet is sufficiently dried into paper. The paper is then stored, cut and/or otherwise converted in known manner into useful products.

During processing, a chemical softening composition according to the invention may be added at any one of a variety of locations. For example, the chemical softening composition can be added to the locations where the papermaking fibers are in aqueous dispersion such as the head box, the machine chest or stuff box. The chemical softening composition can also be sprayed onto a wet paper web or applied to a dried paper web. The chemical softening composition can also be effectively applied to the papermaking fibers during the drying process or subsequent to the drying process, such as spraying the chemical softening composition onto the calender rolls.

Preferably, the chemical softening composition is applied to the aqueous dispersion of papermaking fibers prior to dewatering. It has been found that the chemical softening composition of this invention is highly retained on the papermaking fibers when it is added to the aqueous dispersion of papermaking fibers before formation of the paper web or to a wet paper web, therefore making the chemical softening composition highly effective.

While not wishing to be bound by theory, it is believed that, due to the formation of mixed component micelles, the nonionic surfactant and polyhydroxy components of the chemical softening composition described in this invention have the ability to retain on the papermaking fibers when the chemical softening composition is added to an aqueous dispersion of fibers before they are formed into a wet web. The mixed micelles contain mixtures of the amide-substituted imidazolinium methosulfate salt, nonionic surfactant and polyhydroxy compound. The cationic nature of the imidazoline makes the chemical softening composition highly attractive to the fibers. The aggregation or the interaction of the nonionic surfactants and polyhydroxy components with imidazoline results in retention of the nonionic components on the fibers. This phenomenon has been found to lead to a synergistic mixture, resulting in an improved softness when compared to use of the individual components alone. Furthermore, it is believed that the chemical softening composition reduces the surface tension on and within the interstices of the papermaking fibers, thereby debonding them yet also permitting them to mesh together more closely, thus providing a stronger sheet of paper.

In addition, a reduction in, or elimination of, foaming can be expected when using a chemical softening composition according to the invention when it is added to the papermaking fibers at the wet-end of the process. That is, the nonionic surfactant, polyhydroxy compound and the amide substituted amide-substituted quaternary imidazolinium (methylsulfate or ethylsulfate) salt will increase surface tension to levels significantly higher than those obtained when using either an anionic surfactant alone, or an unbalanced blend of anionic and cationic softening agents.

The present invention provides a chemical softening composition having the ability to impart to fabric (that is, articles of clothing, textiles, and so forth), properties including softness to the touch, ease of handling, increased lubricity, and a reduced tendency to carry or generate static electricity. One form in which the chemical softening composition of the present invention is provided is as a liquid, for instance, as an emulsion or as a solution/suspension. During use, an appropriate controlled amount of the chemical softening composition is employed, for example, by pouring the liquid chemical softening composition directly into a washing machine. Typically, the liquid chemical softening composition is dispensed during the rinse cycle of the washing machine by either pouring in by hand or metering in by an appropriate automatic metering device with which the washing machine is equipped. What now follows is illustrative of the invention, and not delimitive in any way.

EXAMPLE 1

Tissue Softness and Stability Evaluation

Test solutions were prepared to determine the ability of a chemical softening composition according to the present invention to soften paper. The test solutions used during this evaluation were prepared in deionized (DI) water so as to make a one (1) percent by weight solution of the materials described for each Sample described below:

Sample 1: Eighty 80.00% by weight of a amide-substituted quaternary imidazolinium methylsulfate salt having the general structure:

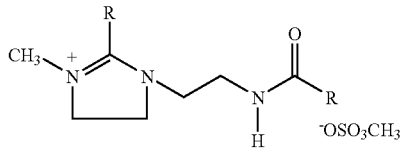

wherein R is an oleic acid residue, is combined with twenty 20.00% by weight POGOL® 400. This product is sold by Huntsman International LLC (The Woodlands, Tex.) under the trade name "HARTOSOFT® DBS-5080M".

Sample 2: pure Polyethylene glycol ("PEG") 200 dilaurate.

Sample 3: pure PEG 400 dioleate.

Sample 4: 10% by weight of Sample 1+90% by weight of PEG 200 dilaurate.

Sample 5: 10% by weight of Sample 1+40% by weight of PEG 400 dioleate+50% by weight of PEG 200 dilaurate.

Sample 6: 10% by weight of Sample 1+20% by weight of PEG 400 dioleate+70% by weight of PEG 200 dilaurate.

Sample 7: 10% by weight of Sample 1+20% by weight of PEG 600 DO+70% by weight of PEG 200 dilaurate.

Sample 8: 10% by weight of Sample 1+20% by weight of PEG 400 MO+70% by weight of PEG 200 dilaurate.

Sample 9: PEG 400 MO.

The test solutions were then assessed for their ability to soften paper using 7"×3" sections of untreated standard tissue paper. Each tissue was immersed into the specified test solution for 60 seconds and then withdrawn. The treated tissue samples were then dried in an oven at 25° C. The treated tissues were evaluated objectively and ranked for softness to the touch using the following scale:

0=Poor/harsh texture

1=Fair

2=Good

3=Very Good

4=Excellent/very soft texture

The results of this testing are reported below in Table 1:

TABLE 1

| Sample | Softness |
|---|---|
| Deionized Water | 0 |
| Sample 1 | 3 |
| Sample 2 | 3 |
| Sample 3 | 3 |
| Sample 4 | 3.5 |
| Sample 5 | 4 |
| Sample 6 | 3.5 |
| Sample 7 | — |
| Sample 8 | — |
| Sample 9 | 1.5 |

The inventive chemical softening compositions, Samples 5, 6, and in particular Sample 5, show superior softness as compared to the prior art.

The stability of the test solutions was also evaluated. The following scale was used to grade the stability of the test solutions:

0=very unstable (i.e. solution separates into visible layers within 1 minute)

1=fair

2=good

3=very good

4=excellent

The results of this testing is reported below in Table 2:

TABLE 2

| Sample | Stability of 1% Test Solution |
|---|---|
| Sample 1 | 1 |
| Sample 2 | 0 |
| Sample 3 | 0 |
| Sample 4 | 1 |
| Sample 5 | 3 |
| Sample 6 | 2 |
| Sample 7 | 2/3 |
| Sample 8 | 2/3 |
| Sample 9 | 3 |

It is shown that inventive Sample 5 is much more stable than the prior art treatments, as well as the individual components, thus indicating unexpected beneficial interactions between the amide-substituted quaternary imidazolinium methylsulfate salt, the nonionic surfactant and the polyhydroxy compound. Furthermore, Sample 5 was found to have a very low pour point (ASTM D-97), below 10° C., as compared to about 31° C. for Sample 2. Therefore, addition of a nonionic surfactant blend of PEG 400 dioleate and PEG 200 dilaurate to the amide-substituted quaternary imidazolinium methosulfate salt and polyhydroxy compound is demonstrated to lower the pour point significantly. Thus, in addition to providing superior softness and strength to paper web and its resulting paper product, the chemical softening composition of the present invention is shown to exhibit low pour points, is low foaming, and excellent dispersibility in water.

While the aforesaid embodiments are concerned with a single most preferred imidazolinium salt, the present invention embraces aqueous compositions which comprise a cation having the structure:

(III)

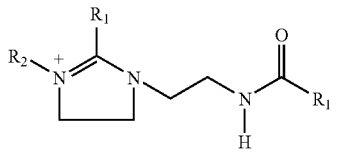

wherein $R_1$ in each occurrence is independently selected from the group consisting of: hydrogen or any hydrocarbyl group comprising 8 to 22 carbon atoms and wherein $R_2$ is selected from the group consisting of: hydrogen, methyl, or ethyl. The anionic counterion present with such a cation is really of little consequence to the overal performance of a solution according to the invention as heretofore described. Thus any suitable counteraion sufficient to render the solution as a whole electronically neutral is useful in accordance with the present invention. Dimethyl sulfate is a particularly preferred material for the alkylation and the presence of the methylsulfation anion is merely for convenience. Alkylations carried out using, say, methyl chloride or ethyl chloride, will result in a halide anion being present in the product, which is of no detriment from a performance standpoint. Suitable alkylating agents known in the art which are capable of alkylating the nitrogen atome bearing a methyl group in the above structure and having any number of carbon atoms between 1 and 12 are suitable for use in preparing an imidazolinium cation suitable for use in accordance with the present invention. However, as the alkyl chain becomes longer than about 2 carbon atoms, reaction product yields are adversely affected by the bulkiness of such substituents (steric effects) and for this reason alone the methyl and ethyl substituted materials are preferred components of a composition according to the invention.

Consideration must be given to the fact that although this invention has been described and disclosed in relation to certain preferred embodiments, obvious equivalent modifications and alterations hereof will become apparent to one of ordinary skill in this art upon reading and understanding this specification and the claims appended hereto. Accordingly, the presently disclosed invention is intended to embrace all such modifications and alterations, and is limited only by the scope of the claims which follow.

What is claimed is:

1. A process for softening a paper product comprising:

providing a paper product;

contacting the paper product with a composition, wherein the composition comprises:

i) an amide-substituted quaternary imidazolinium salt present in the amount from about 0.25% to about 20.00% by weight based upon the total weight of the composition;

ii) a nonionic surfactant in an amount between 20.00% and 90.00% based on the total weight of the composition; and iii) a polyhydroxy compound having an average molecular weight which is any molecular weight in the range of 92 to 4000 in an amount from about 1.00% to about 10.00% by weight based on the total weight of the composition, wherein the amide-substituted quaternary imidazolinium salt comprises a cation having the structure:

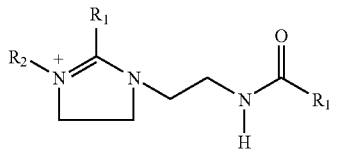

in which $R_1$ in each occurrence is independently selected from the group consisting of:

hydrogen or a hydrocarbyl group comprising any number of carbon atoms between 8 to 22 and wherein, $R_2$ is selected from the group consisting of: hydrogen, or any $C_1$ to $C_{12}$ hydrocarbyl group, including mixtures of cations meeting this description.

2. A process according to claim 1 wherein the nonionic surfactant comprises an ethylene oxide moiety.

3. A process according to claim 1 wherein the paper product is selected from the group consisting of: a paper towel, a tissue paper, a paper napkin, and a feminine hygiene product.

4. The process according to claim 1 wherein the amide-substituted quaternary imidazolinium salt is present in the amount from about 3.00% to about 15.00%.

5. The process according to claim 1 wherein the amide-substituted quaternary imidazolinium salt is present in the amount from about 5.00% to about 10.00%.

6. The process according to claim 1 wherein the non-ionic surfactant is polyethylene glycol dioleate, polyethylene glycol dilaurate, polypropylene glycol dioleate, polypropylene glycol dilaurate, polyethylene glycol monooleate, polyethylene glycol monolaurate, polypropylene glycol monooleate and polypropylene glycol monolaurate, and mixtures thereof.

7. The process according to claim 1 wherein the nonionic surfactant comprises about 40% by weight polyethylene glycol 400 dioleate and about 50% by weight polyethylene glycol 200 dilaurate.

8. The process according to claim 1 wherein the polyhydroxy compound is present in the amount from about 1.00% to about 5.00%.

9. The process according to claim 1 wherein the polyhydroxy compounds is glycerine and polyalkylene glycols.

10. A process for softening a paper product comprising:

providing a paper product;

contacting the paper product with a composition, wherein the composition consists essentially of:

i) an amide-substituted quaternary imidazolinium salt present in the amount from about 0.25% to about 20.00% by weight based upon the total weight of the composition;

ii) a nonionic surfactant in an amount between 20.00% and 90.00% based on the total weight of the composition; and iii) a polyhydroxy compound having an average molecular weight which is any molecular weight in the range of 92 to 4000 in an amount from about 1.00% to about 10.00% by weight based on the total weight of the composition, wherein the amide-substituted quaternary imidazolinium salt comprises a cation having the structure:

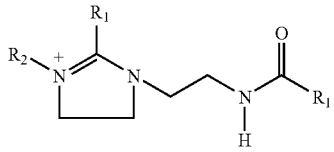

in which $R_1$ in each occurrence is independently selected from the group consisting of:

hydrogen or a hydrocarbyl group comprising any number of carbon atoms between 8 to 22 and wherein, $R_2$ is selected from the group consisting of: hydrogen, or any $C_1$ to $C_{12}$ hydrocarbyl group, including mixtures of cations meeting this description.

* * * * *